United States Patent [19]

Rieke

[11] Patent Number: 4,605,128

[45] Date of Patent: Aug. 12, 1986

[54] DISPENSING CARRIER BOX AND BLANK

[75] Inventor: Herbert W. Rieke, Indianapolis, Ind.

[73] Assignee: Scott Paper Company, Philadelphia, Pa.

[21] Appl. No.: 757,592

[22] Filed: Jul. 22, 1985

[51] Int. Cl.[4] ..... B65D 5/54

[52] U.S. Cl. ..... 206/611; 206/449; 206/624; 229/40

[58] Field of Search ..... 229/40, 33; 206/449, 206/611, 620, 628, 624, 427, 430

[56] References Cited

U.S. PATENT DOCUMENTS

| | | | |
|---|---|---|---|
| D. 244,355 | 5/1977 | Mazie et al. | D9/224 |
| D. 269,068 | 5/1983 | Mann, Sr. et al. | D9/416 |
| D. 270,041 | 8/1983 | Vestal | D9/416 |
| 1,905,992 | 4/1933 | Bogren | 206/449 |
| 2,262,803 | 11/1941 | Huffield | 206/449 |
| 2,448,819 | 9/1948 | Mitchell | 206/449 |
| 2,801,000 | 7/1957 | Busch | 206/56 |
| 2,967,010 | 1/1961 | Cuffey, Jr. et al. | 206/604 |
| 2,968,431 | 1/1961 | Pellation | 229/17 R |
| 3,750,930 | 8/1973 | Roth | 206/620 |
| 4,032,053 | 6/1977 | Wilson | 206/428 |
| 4,155,449 | 5/1979 | Bryne | 206/427 |
| 4,318,474 | 3/1982 | Hasegawa | 206/428 |
| 4,375,258 | 3/1983 | Crayne et al. | 206/141 |
| 4,378,877 | 4/1983 | Botterman et al. | 206/141 |
| 4,398,636 | 8/1983 | Baxter | 206/614 |

FOREIGN PATENT DOCUMENTS

| | | | |
|---|---|---|---|
| 357329 | 11/1961 | Switzerland | 229/40 |

*Primary Examiner*—William Price
*Assistant Examiner*—Gary E. Elkins
*Attorney, Agent, or Firm*—J. H. Yamaoka; J. W. Kane, Jr.

[57] ABSTRACT

An enclosed box in which the top wall and the upper sections of each side wall extend only over a central portion of the length of the box, and in which side flaps and a top flap at each end of the box tuck within the side walls and under the top wall to form an enclosed box. An upper section of each end wall and side flap along with the top flaps are removable to provide access into the box.

9 Claims, 4 Drawing Figures

DISPENSING CARRIER BOX AND BLANK

TECHNICAL FIELD

This invention relates to an enclosed box suitable for packaging articles. More particularly, this invention relates to an enclosed box, suitable for shipping or storing articles, which has removable opposed upper end sections and a handle that can be attached to the top panel of the box, so that the box can be used to carry and dispense articles placed in the box.

BACKGROUND ART

Packages for dispensing paper products and other articles wherein the package has a dispensing opening that can be formed by removing one upper corner of the package are disclosed in U.S. Pat. Nos. 2,801,000—Busch; 2,967,010—Cuffey, Jr., et al.; 2,968,431—Pellaton; Des. 269,068—Mann, Sr., et al.; Des. 270,041—Vestal; and Des. 244,355—Mazie, et al. Carrier packages for bottles and other containers wherein dispensing openings are formed at opposed upper ends of the box are disclosed in U.S. Pat. Nos. 4,032,053—Wilson; 4,318,474—Hasegawa; 4,375,258—Crayne, et al.; 4,378,877—Botterman, et al.; and 4,398,636—Baxter.

It is an object of this invention to provide an enclosed box for articles which can be converted into a dispensing carrier box by removing opposed upper end sections of the box.

It is another object of this invention to provide an enclosed box in which the top wall and the upper sections of each side wall extend over a central portion of the length of the box, and in which side flaps and a top flap connected to end walls at each end of the box tuck within the side walls and under the top wall to form an enclosed box.

Another object of this invention is to have the enclosed box described in the preceding object converted into a dispensing carrier by attaching a handle to the top wall and by removing the top flaps, the upper sections of the side flaps and the upper sections of each end wall.

It is another object of this invention is to provide a unitary blank which can be easily assembled into the above-described dispensing carrier.

And yet another object of this invention is to provide a unitary blank that can be assembled into a carrier dispenser without the use of glue or other fastening means.

DISCLOSURE OF THE INVENTION

In accordance with the invention, there is provided a dispensing carrier box having a top wall spanning a central portion of the dispenser, a bottom wall, a pair of opposed side walls each having a lower section connected to the bottom wall and extending the length of the dispenser and an upper section connected to the top wall and extending along a central portion of the length of the dispenser, and opposed end walls each comprising a lower section hingedly connected to the bottom wall, and an upper section removably connected to the lower section. Each end wall has a top flap, hingedly connected to its upper edge, which tucks under the top wall of the dispensing carrier box. Each end wall also has a pair of side flaps each hingedly connected to a lower side edge of the end wall and each tucking inside its respective side wall to form an enclosed box. Each side flap has a removable upper section which, along with the top flaps and an upper section of the end wall can be removed to provide a dispensing or access opening at opposed upper ends of the dispensing carrier box.

The blank for forming the dispensing carrier box of this invention has an inner first side wall panel having a lower section extending the length of the dispensing carrier box and an upper section extending along a central portion of the length of the box. A bottom panel has one edge hingedly connected to the lower edge of the inner first side wall and the edge opposite the one edge hingedly connected to a second side wall having a lower section extending the length of the box and an upper section extending along a central portion of the length of the dispensing carrier box. The blank has a top wall that has one edge hingedly connected to the upper edge of the second side wall and the edge opposite the one edge hingedly connected to the upper edge of an outer first side wall having an upper section extending along a central portion of the length of the box and having a lower section extending the length of the dispensing carrier box. The blank also has two lower end walls each hingedly connected to opposed edges of the bottom wall and two upper end walls each removably connected to a respective lower end wall. The blank has two top flaps each hingedly connected to a respective upper end wall and having sufficient length to be able to be tucked under the top wall and two pairs of side flaps, each flap having a lower section hingedly connected to a respective lower end wall and an upper removable section adjacent its respective upper end wall.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
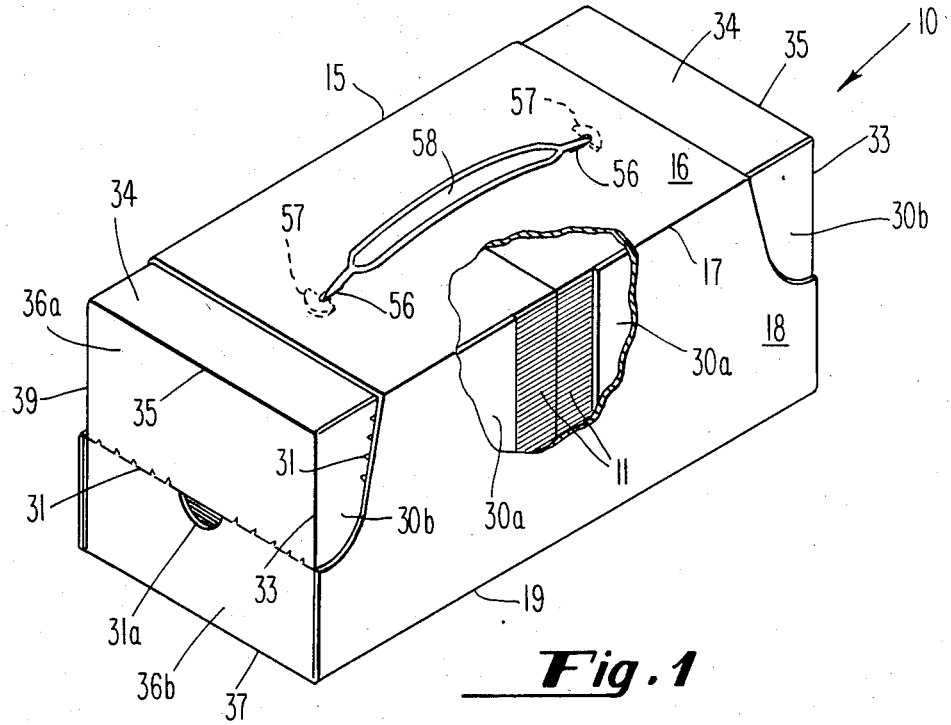
FIG. 1 is an isometric view of the enclosed dispenser carrier box of this invention.

For the sake of convenience, elements described with reference to a specific Figure will retain the same reference designation in the description of subsequent Figures.

As shown in the Figures, the enclosed dispensing carrier box 10 has a bottom wall 20, a first side wall comprising a side wall member 18 and a pair of side flaps 30, a top wall comprising a top wall member 16 and a pair of top flaps 34, a second side wall comprising inner and outer side wall members 22, 14 and a pair of side flaps 38, and opposed end walls 36. As shown by the cut away portions of the top wall 16 and side wall 18 in FIG. 1, the package 10 can be used to store or ship articles such as two stacks of paper wipers 11.

Figure 4:
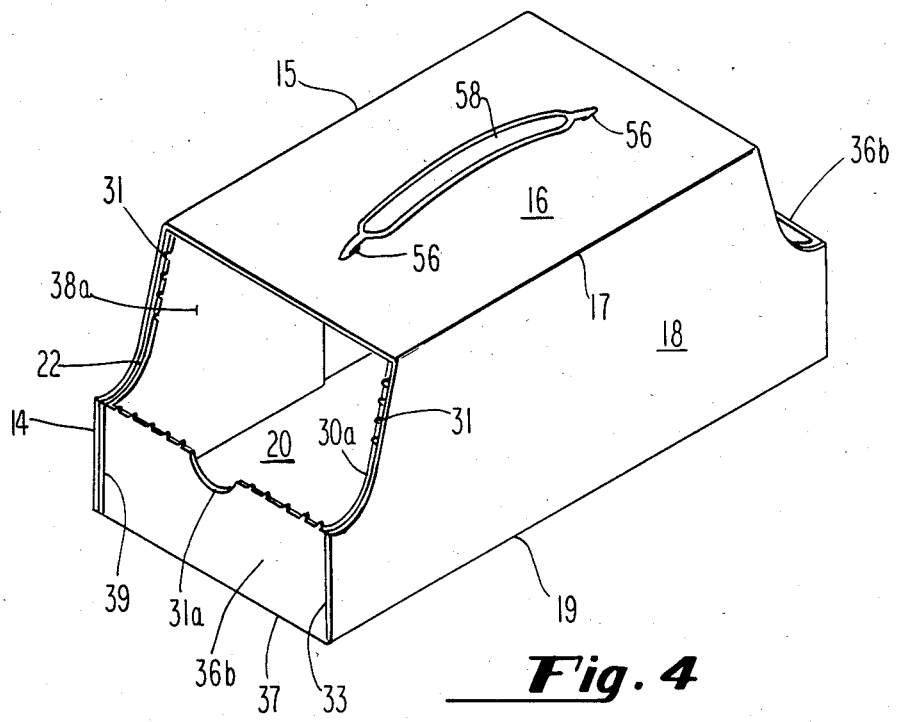
FIG. 4 is an isometric view of the box of FIG. 1 with opposed upper end portions of the box removed.

The side wall members 14, 18 and 22 are shaped to have a lower section that extends the entire length of the dispenser box 10. Notches are cut out of the upper corners of the side wall members 14, 18 and 22 so that the upper section of each side wall member only extends over a central portion of the length of the dispenser box 10. Top wall 16 also only spans the central portion of the length of the dispenser box 10. Closure of the box 10 is accomplished by means of the end flaps 34 which tuck under the top wall 16 and by means of the side flaps 30, 38 which tuck inside of the side wall members 18, and 14, 22. The upper sections 36*a* of end walls 36 along with top flaps 34 and removable upper sections 30*b*, 38*b* of side flaps 30, 38 are removable to provide access to the interior of the dispensing carrier box 10 as illustrated in FIG. 4. As shown in the Figures, top wall 16 can be provided with two slots 56 into which the ends 57 of a handle 58 can be inserted and held by top wall 16. The ends 57 of the handle can have a T-shape so that they will be retained under the top wall 16. As shown in FIG. 1, the dispensing carrier box 10 can be used to carry and dispense two stacks of wipers 11. The carrier dispenser box 10 can also be used to carry and dispense a single stack of wipers from one-half of the box 10 while the other half of the dispensing carrier box 10 stores supplies such as cleaners, sprays or brushes.

Figure 2:
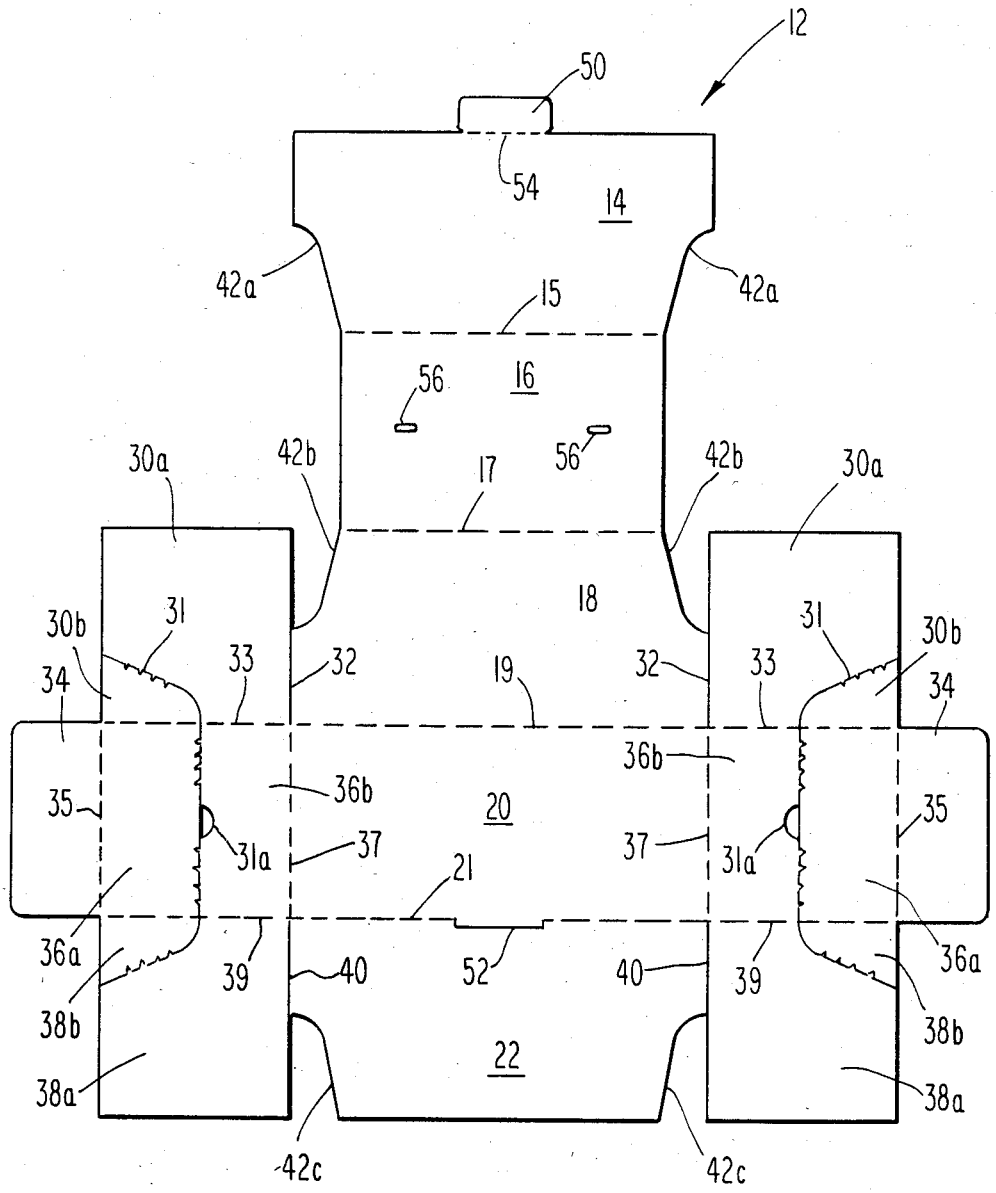
FIG. 2 is a plan view of the blank for forming the box of FIG. 1.

Referring now to FIG. 2, there is shown a blank 12 for forming the carrier dispenser box 10. The blank 12 is scored as indicated by dashed lines 15, 17, 19 and 21 to provide an outer side wall 14 which is hingedly connected to top wall 16 at the score line 15. In a similar manner, the top wall 16 is hingedly connected at score line 17 to side wall 18; side wall 18 is hingedly connected at score line 19 to bottom wall 20; and bottom wall 20 is hingedly connected at score line 21 to inner side wall 22. Cut lines 42*a*, 42*b* and 42*c* in side wall members 14, 18 and 22 respectively result in the upper portion of both side wall members extending only over a central portion of the length of the entire box. The ends of top wall 16 are also cut so that its length is equal to the length of the upper edge of side wall members 14 and 18.

The score lines 19 and 21 are extended at each end as score lines 33 and 39. Cut lines 32 and 40 and score lines 33 and 39 define side flaps 30 and 38 hingedly connected by means of score lines 33 and 39 respectively to end walls 36. As a result of score lines 37, each end wall 36 is hingedly connected to an end of bottom wall 20. Top flaps 34 are hingedly connected to end walls 36 by means of score lines 35. The lines 31 are partially scored and partially cut lines that extend from one side flap 30, traverse across end wall 36 and extend across side flap 38. Each cut/score line 31 divides a side flap 30 into a permanent section 30*a* and a removable section 30*b*; divides an end wall 36 into a permanent section 36*b* and a removable section 36*a*; and divides a side flaps 38 into a permanent section 38*a* and a removable section 38*b*.

In a preferred embodiment, a tab 50 is hingedly connected to side wall 14 by means of a score line 54, and a cut line 52 can be placed along the bottom edge of side wall member 22 in order to form a slot for receiving tab 50 during assembly of the dispensing carrier box 10. Holes or slots 56 can be punched in top wall 16 in order to receive and hold the ends 57 of an attachable handle 58. In addition, semicircular cut lines 31*a* in each end wall 36 can be provided to assist in the removal of the opposed upper corners of an assembled enclosed box 10.

Figure 3:
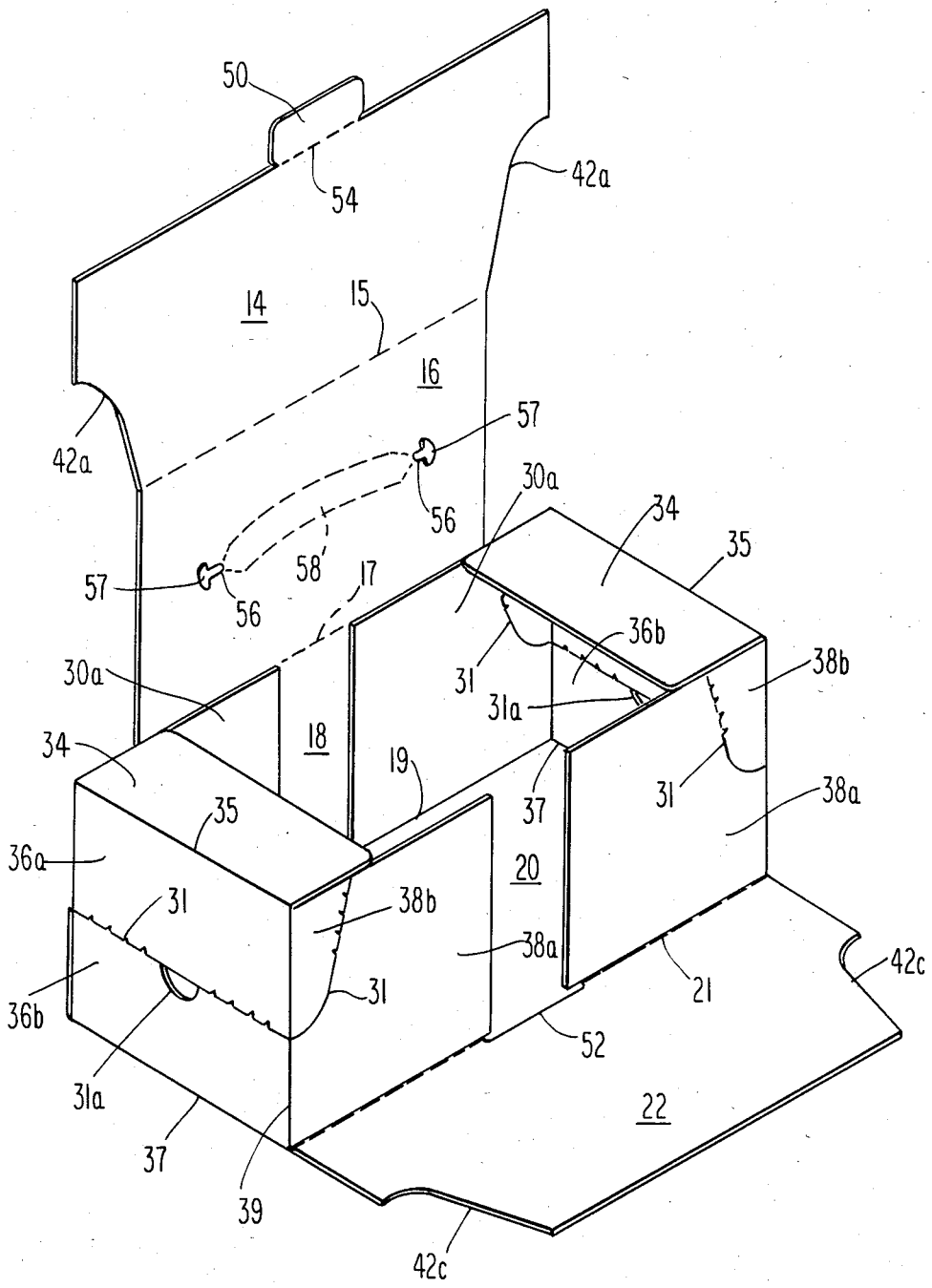
FIG. 3 is an isometric view of a partially assembled box.

What follows is a description of how the blank 12 is assembled into an enclosed dispensing carrier box 10. The two end walls 36 are bent upward about score line 37. The side flaps 30 and 38 are folded inwardly about score lines 33 and 39 respectively. Then the top flaps 34 can be bent downward about score line 35. The end walls 36, side flaps 30 and 38 and top flaps 34 will have the position illustrated in FIG. 3. Side wall 18 is then bent upward about score line 19. At this point, the partially assembled dispensing carrier box 10 will be exactly as illustrated in FIG. 3. The assembly can be completed by bending inner side wall member 22 upward about score line 21, then bending top wall 16 downward about score line 17, then bending outer side wall 14 downward about score line 15, bending tab 50 inward about score line 54 and inserting the tab into the slot at the bottom of inner side wall 22, the slot being formed by the cut line 52. As shown in FIG. 1, the enclosed dispensing carrier box 10 can be used to ship or store articles.

To convert the enclosed box 10 into a carrier dispenser as show in FIG. 4, the top flaps 34, upper side flap sections 30*b* and 38*b*, and upper end walls 36*a* are removed by tearing the scored segments of cut/score line 31. The semicircular hole formed by cut line 31*a* is provided to help initiate the tearing of the scored portion of the cut/score line 31.

While the present invention has been described with reference to a specific embodiment thereof, it will be obvious to those skilled in the art that various changes and modifications may be made without departing from the invention in its broader aspects. For example, although a tab and slot arrangement has been described for holding the formed box in its assembled state, it is clear that other means such as staples, clips, glue, etc., could be used to hold or fasten the carrier box 10 in its assembled state.

What is claimed as new and desired to be secured by Letters Patent of the United States is:

1. A carrier dispenser comprising:

(a) a top wall spanning a central portion of the dispenser;

(b) a bottom wall;

(c) a pair of opposed side walls each having a lower section extending the length of the dispenser and an upper section extending along a central portion of the length of the dispenser;

(d) opposed end walls each comprising a lower section adjacent to the bottom wall, and an upper section connected to the lower section by a partially cut score line;

(e) a top flap connected to each upper end wall section by a fold line and tucked under the top wall; and (f) each end wall having connected thereto a pair of side flaps each side flap having an upper section and a lower section connected to the upper section by a partially cut score line and connected to one of the lower end wall sections by a fold line, the side flaps being tucked inside the side walls to close the container and whereby the upper end walls, top flaps and upper side flap sections can be detached to provide an access opening into the dispenser.

2. A carrier dispenser as recited in claim 1 wherein each lower end wall section is connected to the bottom wall by a fold line.

3. A carrier dispenser as recited in claim 1 wherein one of the side walls is connected to the top and bottom walls by fold lines and wherein the other side wall comprises an inner wall connected to the bottom wall by a fold line and an outer wall connected to the top wall by a fold line, and further comprising means for connecting the inner and outer side walls together.

4. A carrier dispenser as recited in claim 3 wherein the connecting means comprises a tab, connected to the outer side wall by a fold line, which fits into a slot in the inner side wall.

5. A carrier dispenser as recited in claim 1 additionally comprising a handle assembled into the top wall.

6. A carrier dispenser as recited in claim 5 wherein the top wall includes two slots for receiving the ends of the handle.

7. A blank for forming a dispensing carrier comprising:

(a) an inner first side wall panel having a lower section extending the length of the carrier and an upper section extending along a central portion of the length of the dispenser;

(b) a bottom panel connected to the lower section of the inner first side wall by a fold line;

(c) a second side wall having a lower section extending the length of the carrier and connected to the bottom panel by a fold line and an upper section extending along a central portion of the length of the dispenser;

(d) a top wall connected to the upper section of the second wall by a fold line;

(e) an outer first side wall having an upper section connected to the top wall by a fold line and extending along a central portion of the length of the dispenser and having a lower section extending the length of the carrier;

(f) two lower end walls each connected to the bottom wall by fold lines;

(g) two upper end walls each connected to a respective lower end wall by partially cut score lines;

(h) two top flaps each connected to a respective upper end wall by a fold line and having sufficient length to be able to be tucked under the top wall; and (i) two pairs of side flaps each flap having a lower section connected to a respective lower end wall by a fold line and an upper section adjacent its respective upper end wall connected to the lower section by a partially cut score line.

8. A blank as recited in claim 7 additionally comprising a tab connected to the outer first side by a fold line and wherein the fold line between the bottom panel and the inner side wall includes a cut so as to form a slot to receive the tab when folded.

9. A blank as recited in claim 7 wherein the top wall includes two slots for receiving a handle.

* * * * *